US006631248B2

(12) United States Patent
Serizawa

(10) Patent No.: US 6,631,248 B2
(45) Date of Patent: Oct. 7, 2003

(54) IMAGE FORMING APPARATUS WITH RESTORABLE NON-VOLATILE MEMORY

(75) Inventor: Yoji Serizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/902,598

(22) Filed: Jul. 12, 2001

(65) Prior Publication Data

US 2002/0018657 A1 Feb. 14, 2002

(30) Foreign Application Priority Data

Jul. 13, 2000 (JP) ..... 2000-213202

(51) Int. Cl.[7] ..... G03G 15/00
(52) U.S. Cl. ..... 399/27; 399/25
(58) Field of Search ..... 399/12, 13, 24, 399/25, 27, 30, 58, 59, 111; 222/DIG. 1

(56) References Cited

U.S. PATENT DOCUMENTS 5,258,779 A 11/1993 Serizawa et al.
5,550,573 A 8/1996 Serizawa et al.
5,883,659 A 3/1999 Serizawa et al.
5,923,917 A * 7/1999 Sakurai et al. ..... 399/27
6,188,852 B1 * 2/2001 Ojima et al. ..... 399/25

* cited by examiner

*Primary Examiner*—Hoang Ngo
(74) *Attorney, Agent, or Firm*—Fitzpatrick, Cella, Harper & Scinto

(57) ABSTRACT

An image forming apparatus having a unit with a non-volatile memory provided in a toner cartridge. By controlling the method in which data is written to a non-volatile memory, data that has been rewritten in the memory due to malfunction can be restored. The apparatus includes a detector for detecting the amount of toner remaining in the cartridge. On the basis of this information, a memory controller writes data, which indicates that cartridge replacement is necessary, to a prescribed area of the non-volatile memory. A memory locking unit inhibits rewriting of this area once data has been written. If it is judged by the memory controller that rewriting of the data halted in mid-course, write-protect by the memory lock function unit is cancelled and rewrite is allowed to be completed again, after which rewrite is inhibited.

50 Claims, 19 Drawing Sheets

FIG. 5

| 240 ADDRESS AREA | 241 ADDRESS | 242 CONTENT | |
|---|---|---|---|
| 1 | 000 | CARTRIDGE MANUFACTURING NO. (LOT NO.) | 243 |
| 2 | 001 | RESIDUAL CARTRIDGE TONER (AMOUNT OF USE) | 244 |
| 3 | 010 | CARTRIDGE-TONER-DEPLETED INFORMATION(REPLACE INFORMATION) | 245 |
| 4 | 011 | CHECK SUMS OF ADDRESSES 1 TO 3 | 246 |
| 5 | 100 | NOT USED | |
| 6 | 101 | NOT USED | |
| 7 | 110 | LOCK(WRITE-INHIBIT)SETTING OF ADDRESSES 1 TO 6 | 247 |

FIG. 6

FIRST ADDRESS AREA

CARTRIDGE MANUFACTURING NO.(LOCKED)

| BIT | CONTENT |
|---|---|
| 1st BIT | 2 ^ 7 CODE |
| 2nd BIT | 2 ^ 6 CODE |
| 3rd BIT | 2 ^ 5 CODE |
| 4th BIT | 2 ^ 4 CODE |
| 5th BIT | 2 ^ 3 CODE |
| 6th BIT | 2 ^ 2 CODE |
| 7th BIT | 2 ^ 1 CODE |
| 8th BIT | 2 ^ 0 CODE |

FIG. 7

SECOND ADDRESS AREA

RESIDUAL CARTRIDGE TONER(UNLOCKED)

| BIT | CONTENT |
|---|---|
| 1st BIT | 2 ^ 7 CODE |
| 2nd BIT | 2 ^ 6 CODE |
| 3rd BIT | 2 ^ 5 CODE |
| 4th BIT | 2 ^ 4 CODE |
| 5th BIT | 2 ^ 3 CODE |
| 6th BIT | 2 ^ 2 CODE |
| 7th BIT | 2 ^ 1 CODE |
| 8th BIT | 2 ^ 0 CODE |

FIG. 8

THIRD ADDRESS AREA

CARTRIDGE-TONER-DEPLETED INFORMATION
(LOCKED AFTER DATA REWRITE)

| BIT | CONTENT |
|---|---|
| 1st BIT | TONER DEPLETED |
| 2nd BIT | 0 |
| 3rd BIT | 0 |
| 4th BIT | 0 |
| 5th BIT | 0 |
| 6th BIT | 0 |
| 7th BIT | 0 |
| 8th BIT | 0 |

FIG. 9

FOURTH ADDRESS AREA

CHECK SUMS OF ADDRESS 1 TO 3 (UNLOCKED)

| BIT | CONTENT |
|---|---|
| 1st BIT | 2 ^ 7 CODE |
| 2nd BIT | 2 ^ 6 CODE |
| 3rd BIT | 2 ^ 5 CODE |
| 4th BIT | 2 ^ 4 CODE |
| 5th BIT | 2 ^ 3 CODE |
| 6th BIT | 2 ^ 2 CODE |
| 7th BIT | 2 ^ 1 CODE |
| 8th BIT | 2 ^ 0 CODE |

FIG. 10

SEVENTH ADDRESS AREA

LOCKING SETTINGS OF ADDRESSES 1 TO 6

| BIT | CONTENT |
|---|---|
| 1st BIT | ADDRESS 1 WRITE-PROTECT |
| 2nd BIT | ADDRESS 2 WRITE-PROTECT |
| 3rd BIT | ADDRESS 3 WRITE-PROTECT |
| 4th BIT | ADDRESS 4 WRITE-PROTECT |
| 5th BIT | ADDRESS 5 WRITE-PROTECT |
| 6th BIT | ADDRESS 6 WRITE-PROTECT |
| 7th BIT | 0 |
| 8th BIT | 0 |

FIG. 18

| MEMORY ADDRESS | MEMORY CONTENT | |
|---|---|---|
| 01h | CONTENT A | 141 |
| 02h | CONTENT B | 142 |
| 03h | CONTENT C | 143 |
| 04h | CONTENT D | 144 |
| 05h | CONTENT E | 145 |
| 06h | CONTENT F | 146 |
| 07h | CHECK SUMS OF CONTENT A TO F | 147 |
| 08h | NOT USED | 148 |
| 09h | BACK UP OF CONTENT A | 149 |
| 0Ah | BACK UP OF CONTENT B | 150 |
| 0Bh | BACK UP OF CONTENT C | 151 |
| 0Ch | BACK UP OF CONTENT D | 152 |
| 0Dh | BACK UP OF CONTENT E | 153 |
| 0Eh | BACK UP OF CONTENT F | 154 |
| 0Fh | CHECK SUMS OF CONTENT A TO F BACK-UP | 155 |

IMAGE FORMING APPARATUS WITH RESTORABLE NON-VOLATILE MEMORY

FIELD OF THE INVENTION

This invention relates to an image forming apparatus and to an apparatus unit, which has a non-volatile memory, removably attached to the main body of the image forming apparatus. More particularly, the invention relates to an image forming apparatus and to an apparatus unit thereof, wherein even if data in a non-volatile memory has been rewritten as a result of a malfunction in the image forming apparatus, the rewritten content can be restored, without internally providing the non-volatile memory with data back-up area, by controlling the method in which data is written from the main body of the image forming apparatus to the non-volatile memory.

BACKGROUND OF THE INVENTION

A laser printer 30 shown in FIG. 14 is an example of an electrophotographic printer according to the prior art. The structure and functions thereof are as follows:

An optical unit 5 generates a laser beam 6, and the laser beam 6 thus generated irradiates a photosensitive drum 1. The latter is charged uniformly by a charging roller 2. An electrostatic latent image is formed on the photosensitive drum 1 by the laser beam 6 that irradiates the drum.

The electrostatic latent image formed on the photosensitive drum 1 by the laser beam 6 is developed by toner in a developing unit 3. A transfer charging roller 4 is for transferring the toner image, which has been formed on the photosensitive drum 1, to a prescribed printing paper P. The toner image that has been transferred to the paper P is fused and fixed to the paper P by a fixing unit 7.

Next, the paper P is ejected to the exterior of the machine by ejection rollers 12. An ejection sensor 14 confirms whether or not the paper P has been ejected from the fixing unit 7 normally. The paper P is stacked in a standard cassette 8. The paper P is transported from the standard cassette 8 by a paper feed roller 9, and a registration sensor 13 is used to register the leading edge of the paper in order that the paper P may be printed on. Whether or not paper P is present in the standard cassette 8 is checked using a sensor 15.

In a case where the printing paper P is supplied from a manual feed tray 10, the paper is transported from the manual feed tray by a manual feed roller 11. Whether or not paper P is present in the manual feed tray 10 is checked using a sensor 16.

The above-described photosensitive drum 1, charging roller 2, developing unit 3 and toner are integrated within a toner cartridge 17. The latter has a structure that allows it to be attached to and detached from the laser printer 30. The toner cartridge 17 is fitted with a non-volatile memory 18 storing information relating to the toner cartridge 17 (e.g., status of use of the toner cartridge, whether or not it is necessary to replace the photosensitive drum, etc.).

In the prior art, signals are exchanged between a printer control unit 20, which is provided in the main body of the laser printer 30, and the non-volatile memory 18 mounted on the toner cartridge 17, via a connector 19. The printer control unit 20 writes data relating to, say, the status of use of the toner cartridge, to the non-volatile memory 18 and exercises control of the toner cartridge using this data, e.g., performs control such as management of whether or not the photosensitive drum requires replacement.

FIG. 15 is a block diagram illustrating the printer control unit 20 according to the prior art.

The functions of various blocks will be described first. A printer controller 101 communicates with a host computer (not shown), receives image data, expands the received image data into information capable of being printed by the printer, and exchanges signals with and communicates serially with a printer-engine controller 102, described later.

The engine controller 102 exchanges signals with the printer controller 101 and controls the various blocks, described later, of the printer control unit 20 via serial communication. A paper transport controller 103 feeds and transports printing paper up to the point of paper ejection following printing in accordance with a command from the engine controller 102, and an optics controller 104 drives a scanner motor (not shown) and controls the ON/OFF operation of the laser beam 6 in accordance with a command from the engine controller 102.

A high-voltage controller 105 controls the output of high voltage, which is necessary for the charging, development and transfer steps of the electro-photographic process, in accordance with a command from the engine controller 102, and a fixing-temperature controller 106 controls the temperature of the fixing unit 7 in accordance with a command from the engine controller 102, and senses malfunction of the fixing unit 7.

If information from a sensor indicating whether or not paper is present in the paper feeder and paper transport path, information indicative of a transport problem during paper transport or information indicative of a malfunction in any of the functional blocks of the printer is sensed by a paper-presence sensor input unit 107, jam sensor 108 or malfunction sensor 109, these sensors send the information to the engine controller 102.

The toner cartridge 17 has a structure that allows it to be attached to and detached from the printer control unit 20. The toner cartridge 17 is internally equipped with the non-volatile memory 18 capable of sending data to and receiving data from the engine controller 102. Data can be read out of the engine controller 102 and data can be written to the engine controller 102.

On the basis of data sensed by the printer controller 101 or printer control unit 20, the engine controller 102 reads out the content of the non-volatile memory 18 or rewrites the content of the non-volatile memory 18.

FIGS. 16 and 17 illustrate the exchange of signals between the printer control unit 20 and non-volatile memory 18. The printer control unit 20 has an internal CPU 120 connected by a serial communication line to the non-volatile memory 18 inside the toner cartridge 17 via a drawer connector 121.

The serial communication line comprises TDATA 124, which is command data output from the printer control unit 20 to the non-volatile memory 18, RDATA 125, which is status sent back from the non-volatile memory 18, SCLK 126, which is a synchronizing clock, power supply VCC 122 and ground GND 123.

TDATA 124 is a signal transmitted if the printer control unit 20 reads out the content of the non-volatile memory 18 and if the printer control unit 20 rewrites the content of the non-volatile memory 18. Read-out/rewrite is specified using a command 127 (FIG. 17).

Further, TDATA 124 transmits, in series following the command 127, an address 128 to an address from which data is desired to be read, and data 129 if the data is desired to be rewritten.

If data is to be read out of the non-volatile memory 18 in response to the command 127 of TDATA 124, an address 130 and the data 131 are sent back. If the non-volatile memory 18 is to be rewritten, the address 130 and write data 131 are sent back.

The conventional non-volatile memory 18 only has functions relating to the above-described read-out and write operations. For example, if the printer control unit 20 writes data that is important in terms of control, such as whether it is necessary to replace the toner cartridge 17 or not, to the non-volatile memory 18, the memory 18 allows this important data to be recovered if it has been rewritten inadvertently due to effects of a malfunction or the like.

The method of recovering this important data is implemented by allocating, to a plurality of addresses, an area to which the important data is to be written. That is, even if a certain data area has been written due to effects of a malfunction or the like, the information at another address is read to perform control so as to recover the data or prevent the data from being lost.

More specifically, a single data content is stored in data areas having two different addresses and an error check function such as a check sum is provided for each address. As a result, if a malfunction such as interruption of power occurs during the writing of data content to one of the data areas and, as a consequence, the writing of the data ceases in mid-course, the check sums of the two data areas are checked after power is restored. Then, if both data areas indicate the same value and the check sums are correct, it is judged that both areas are normal. If the check sum is abnormal for one of the data areas, then the content of the data area for which the check sum is normal is written again to the data area that was judged to be abnormal. This makes it possible to restore the immediately preceding data that was rewritten due to effects of the malfunction.

FIG. 18 illustrates the addresses and structure of the content of the above-described memory according to the prior art.

The memory is provided with areas for writing memory content A141 to A146, and with a check-sum area 147 for the above-mentioned content. The memory is further provided with back-up areas 149 to 154 for writing content identical with that of the content A to F, and with a check-sum area 155 for the content A to F.

FIG. 19 illustrates a flowchart indicating processing for writing data to, e.g., the memory content A141 in accordance with this arrangement. This will now be described.

First, at step S301, data is written to the address of memory content A, then, at step S302, verification is performed to determine whether the write operation ended normally. If the write operation ended normally ("YES" at step S303), control proceeds to step S304, where check sums relating to the areas of memory content A to F are written.

This is followed by step S305, where verification is performed to determine whether the write operation ended normally or not. If the write operation ended normally ("YES" at step S306), the write operation regarding the area A is terminated.

Similarly, data is written to the back-up address of memory content A at step S307 and verification is performed at step S308 to determine whether the write operation ended normally or not. If the write operation ended normally ("YES" at step S309), then check sums relating to the back-up areas of memory content A to F are written at step S310. This is followed by step S311, where verification is performed to determine whether the write operation ended normally or not. If the write operation ended normally ("YES" at step S312), the write operation regarding back-up of the area A is terminated.

By thus writing the same data to two data areas, any cut-off of power during the-writing of data to the memory content A can be dealt with by subsequently recovering the data using the back-up content of memory content A.

However, with the example of the prior art described above, if a data area in the non-volatile memory mounted on the apparatus unit of the image forming apparatus has been rewritten because of a malfunction of some kind, then, in order to restore the content that prevailed prior to the rewrite, the data necessary for restoration must be saved beforehand in a different memory area of the non-volatile memory. This means that a part of the non-volatile memory is used at all times as a back-up memory area for error recovery, as a consequence of which the non-volatile memory cannot be utilized efficiently. If a memory area for saving a large quantity of data is required, then use must be made of a non-volatile memory having a large-capacity memory area.

SUMMARY OF THE INVENTION

Accordingly, an object of the present invention is to provide an image forming apparatus constituted by an image forming apparatus main body and an apparatus unit, which has a non-volatile memory, removably attached to the image forming apparatus main body, wherein by controlling the method through which data is written from the image forming apparatus main body to the non-volatile memory, data content that has been rewritten in the non-volatile memory due to the occurrence of a malfunction in the image forming apparatus can be restored without providing a data back-up area in the non-volatile memory.

Another object of the present invention is to provide the apparatus unit.

According to the present invention, the foregoing objects are attained by providing an image forming apparatus having an image forming apparatus main body and an apparatus unit, which has memory means, removably attached to the image forming apparatus main body, the apparatus comprising: measurement means for measuring status of use of the apparatus unit; determination means for determining, using a measurement value obtained by the measurement means, whether replacement of the apparatus unit is necessary; data update means for updating prescribed data, which has been stored in the memory means, if the determination means has determined that replacement is necessary; and data update control means for controlling updating of the prescribed data to be updated by the data update means.

Further, according to the present invention, the foregoing objects are attained by providing an apparatus unit, which has memory means, removably attached to an image forming apparatus main body, wherein the memory means comprises: a first storage area for storing data representing amount of use of the apparatus unit; a second storage area for storing replace information indicating that replacement of the apparatus unit is necessary; and a third storage area for storing write-protect data for inhibiting a change in the second storage area.

The present invention further provides a method of controlling an image forming apparatus including an image forming apparatus main body and an apparatus unit provided with a memory having a first storage area for storing data representing amount of use of the apparatus unit, a second storage area for storing replace information indicating that replacement of the apparatus unit is necessary, and a third storage area for storing write-protect data for inhibiting a change in the second storage area, the apparatus unit being removably attached to the image forming apparatus main body, the method comprising: an amount-of-use detecting step of detecting amount of use of the apparatus unit and writing the amount of use to the memory; a determination step of determining, on the basis of the amount of use, whether replacement of the apparatus unit is necessary and writing the replace information to the memory if it is determined that replacement is necessary; and a recovery step of determining whether processing for writing the replace information at the determination step ended normally and ending normally the processing for writing the replacement information if it is determined that the processing did not end normally.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 5 is a diagram illustrating the overall content stored in a non-volatile memory;

FIG. 6 is a diagram illustrating the overall content stored in the non-volatile memory;

FIG. 7 is a diagram illustrating the overall content stored in the non-volatile memory;

FIG. 8 is a diagram illustrating the overall content stored in the non-volatile memory;

FIG. 9 is a diagram illustrating the overall content stored in the non-volatile memory;

FIG. 10 is a diagram illustrating the overall content stored in the non-volatile memory;

FIG. 18 is a diagram illustrating the overall content stored in a non-volatile memory according to the prior art.

DETAILED DESCRIPTION OF THE PREFERRED EMBODIMENTS

Preferred embodiments of the present invention will be described in detail in accordance with the accompanying drawings.

Though an image forming apparatus is described according to this embodiment, the scope of the claims is not limited to the example described.

(Overall Structure)

Figure 1:
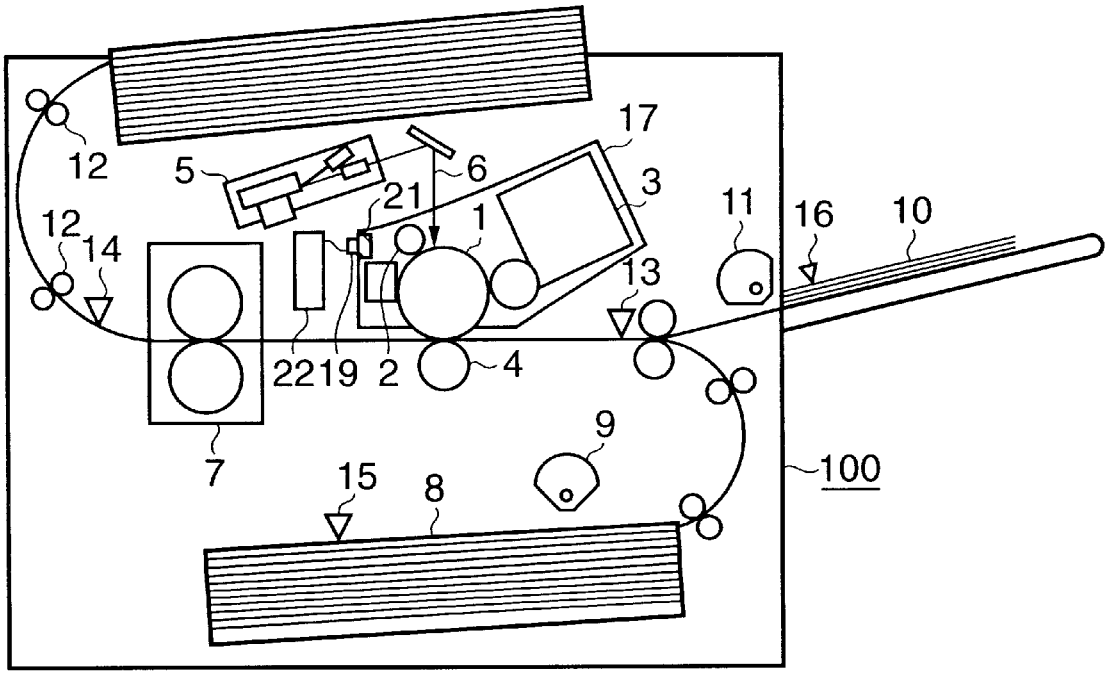
FIG. 1 is a diagram showing an overall structure of a laser printer according to an embodiment of the present invention.

FIG. 1 is a diagram showing an overall structure of a laser printer 100 according to an embodiment of the present invention.

The optical unit 5 generates the laser beam 6, and the laser beam 6 thus generated irradiates the photosensitive drum 1. The latter is charged uniformly by the charging roller 2. An electrostatic latent image is formed on the photosensitive drum 1 by the laser beam 6 that irradiates the drum.

The electrostatic latent image formed on the photosensitive drum 1 by the laser beam 6 is developed by toner in the developing unit 3. The transfer charging roller 4 is for transferring the toner image, which has been formed on the photosensitive drum 1, to the prescribed printing paper P. The toner image that has been transferred to the paper P is fused and fixed to the paper P by the fixing unit 7.

Next, the paper P is ejected to the exterior of the machine by the ejection rollers 12. The ejection sensor 14 confirms whether or not the paper P has been ejected from the fixing unit 7 normally. The paper P is stacked in the standard cassette 8. The paper P is transported from the standard cassette 8 by the paper feed roller 9, and a registration sensor 13 is used to register the leading edge of the paper in order that the paper P may be printed on. Whether or not paper P is present in the standard cassette 8 is checked using the sensor 15.

In a case where the printing paper P is supplied from the manual feed tray 10, the paper is transported from the manual feed tray by the manual feed roller 11. Whether or not paper P is present in the manual feed tray 10 is checked using the sensor 16.

The above-described photosensitive drum 1, charging roller 2, developing unit 3 and toner are integrated within the toner cartridge 17. The latter has a structure that allows it to be attached to and detached from the laser printer 30. The toner cartridge 17 is fitted with a non-volatile memory 21 storing information relating to the toner cartridge 17 (e.g., status of use of the toner cartridge, whether or not it is necessary to replace the photosensitive drum, etc.).

The non-volatile memory 21 has a function for inhibiting rewriting of the content of a prescribed address.

Further, the connector 19, which connects a printer control unit 22 and the non-volatile memory 21 mounted on the toner cartridge 17, is for performing an exchange of signals. The printer control unit 22 reads and writes data to and from the non-volatile memory 21 via the connector 19.

The printer control unit 22 has a function which, when the amount of use of a consumable (described later) of the toner cartridge 17 has exceeded a predetermined amount, writes information, which indicates whether it is necessary to replace the cartridge, to the memory and subjects the memory to a setting that inhibits rewriting of the data.

(Printer Control Unit According to First Embodiment)

Figure 2:
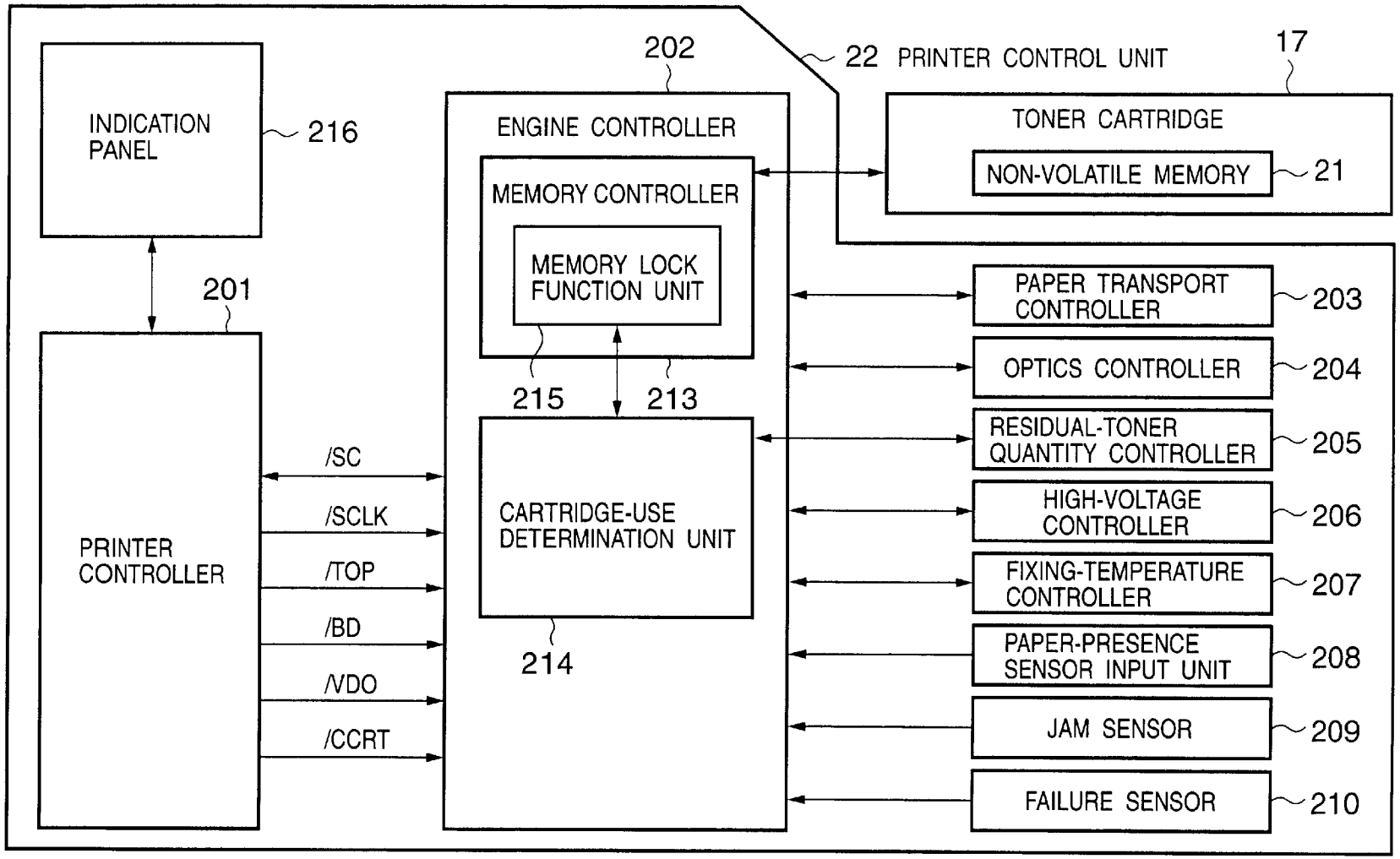
FIG. 2 is a functional block diagram of a printer control unit according to this embodiment.

FIG. 2 is a functional block diagram of the printer control unit 22, in accordance with the first embodiment of the invention, provided in the laser printer 100. The functions of various blocks will now be described.

A printer controller 201 communicates with a host computer (not shown), receives image data, expands the received image data into information capable of being printed by a printer. Further, the printer controller 201 exchanges signals with and communicates serially with a printer-engine controller 202, described later, and is connected to a display panel 216 that displays various information.

The engine controller 202 exchanges signals with the printer controller 201 and controls the various blocks, described later, of the printer control unit 22 via serial communication.

A paper transport controller 203 feeds and transports printing paper up to the point of paper ejection following printing in accordance with a command from the engine controller 202. An optics controller 204 drives a scanner motor (not shown) and controls the ON/OFF operation of the laser beam 6 in accordance with a command from the engine controller 202.

A residual-toner quantity controller 205 detects the amount of toner remaining in the toner cartridge 17 and sends the engine controller 202 information indicative of the remaining amount of toner. A high-voltage controller 206 controls the output of high voltage, which is necessary for the charging, development and transfer steps of the electrophotographic process, in accordance with a command from the engine controller 102.

A fixing-temperature controller 207 controls the temperature of the fixing unit 7 in accordance with a command from the engine controller 202, and senses malfunction of the fixing unit 7. A paper-presence sensor input unit 208 sends the engine controller 202 information from the sensor 15 which senses whether or not the paper P is present in the standard cassette 8.

A jam sensor 209 senses whether or not there is a transport problem during transport of the paper P and sends this information to the engine controller 202. If a malfunction sensor 210 senses a malfunction in any of the blocks constituting the image processing system 100 the sensor sends this information to the engine controller 202.

The toner cartridge 17 has a structure that allows it to be attached to and detached from the laser printer main body 100. The toner cartridge 17 is internally equipped with the non-volatile memory 21 capable of sending data to and receiving data from the engine controller 202. Data can be read out of the engine controller 202 and data can be written to the engine controller 102.

A memory controller 213, which is one of the most important features of the present invention, is provided within the engine controller 202 for reading data out of the non-volatile memory 21 and rewriting the content of the memory. A determination unit 214 for determining amount of use of the cartridge is provided within the engine controller 202. On the basis of information from the residual-toner quantity controller 205, the determination unit 214 determines whether replacement of the toner cartridge 17 is necessary and sends this information to the memory controller 213.

A memory lock function unit 215 is provided within the memory controller 213. On the basis of information from the determination unit 214 indicating whether cartridge replacement is necessary or not, the memory lock function unit 215 writes data indicative of whether cartridge replacement is necessary or not to the non-volatile memory 21 in toner cartridge 17 and executes processing to inhibit rewriting of written data at a prescribed timing.

(Communication Between Printer Control Unit and Non-volatile Memory)

Figure 3:
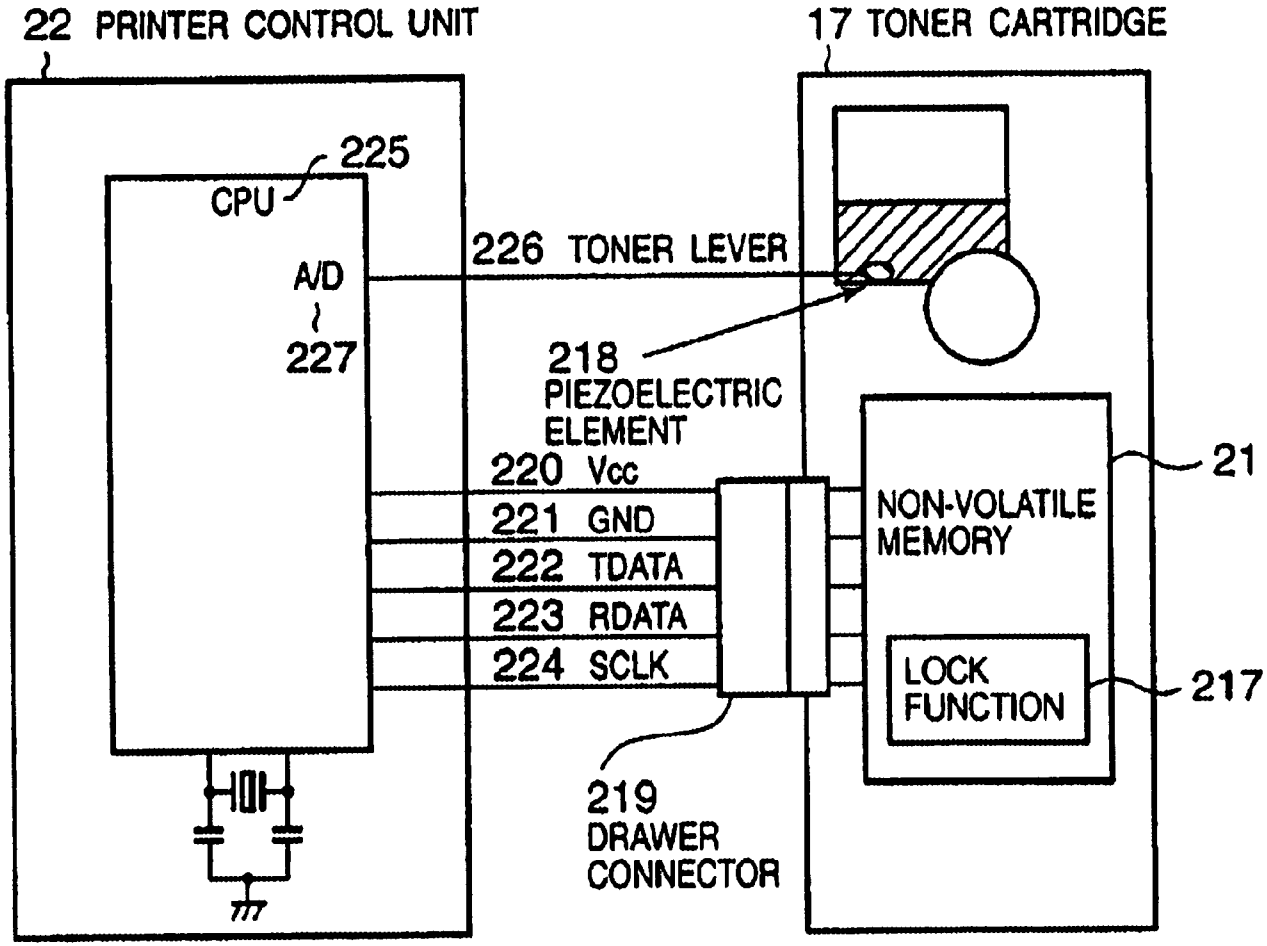
FIG. 3 is a diagram showing the connection between the printing control unit and a toner cartridge according to this embodiment.
Figure 4:
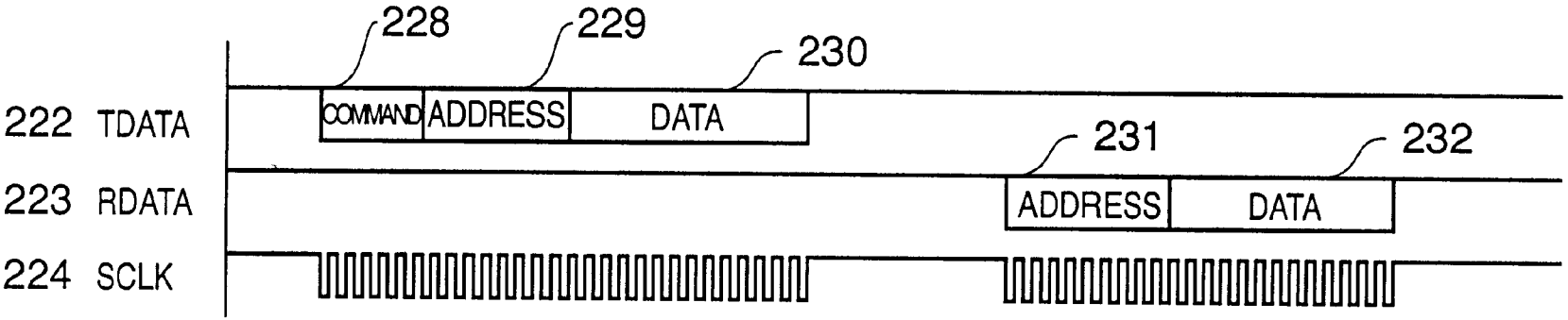
FIG. 4 is a diagram illustrating exchange of signals between the printing control unit and toner cartridge according to this embodiment.

FIGS. 3 and 4 illustrate the connection and the exchange of signals between the printer control unit 22 and non-volatile memory 21.

The printer control unit 22 has an internal CPU 225 connected by a serial communication line to the non-volatile memory 21 inside the toner cartridge 17 via a drawer connector 219. Further, the amount of toner remaining in the developing unit 3 of the toner cartridge 17 is sensed as an analog signal by a piezoelectric element 218. The analog signal is read from an A/D conversion port of the CPU 225 and is converted to a digital signal.

In the example described above, the remaining amount of toner is measured using the piezoelectric element. However, this can also be measured by measuring the change in amount of light using an optical sensor or the like.

The serial communication line comprises TDATA 222, which is command data output from the printer control unit 22 to the non-volatile memory 21, RDATA 223, which is status sent back from the non-volatile memory 21, and SCLK 224, which is a synchronizing clock.

TDATA 222 is a signal transmitted if the printer control unit 22 reads out the content of the non-volatile memory 21 and if the printer control unit 20 rewrites the content of the non-volatile memory 18. Read-out/rewrite is specified by a command 228 (FIG. 4) of TDATA 222.

If it is desired to rewrite an address or data to be read out, the address signal 229 and data signal 230 are transmitted successively following the command signal 228 of TDATA 222.

If data is to be read out of the non-volatile memory 21 in response to the command 228, an address and the data are sent back using an address signal 231 an data 232 of RDATA 223. If the non-volatile memory 18 is to be rewritten, the rewrite address and write data are sent back using the address signal 231 and data 232 of RDATA 223.

The non-volatile memory 21 used in the present invention is characterized in that it has only the read-out and write functions described above. A characterizing feature of the present invention is that the non-volatile memory 21 is internally provided with a function for inhibiting the rewriting of prescribed data (this function shall be referred to as a "lock function 217" below).

(Address Structure of Non-volatile Memory)

FIG. 5 shows an example in which the address structure within the non-volatile memory 21 is illustrated in table form. Here an address area is composed of seven areas each having a data width of eight bits.

The first address area stores the lot number of the toner cartridge, as shown for example in FIG. 6. The data in this area is written and locked when the toner cartridge is manufactured.

The second address area stores the amount of toner remaining in the toner cartridge (i.e., data indicative of amount of use of the toner cartridge) at all times, as shown in FIG. 7. A CPU (not shown) in the engine controller 202 converts analog data, which enters from the residual-toner quantity controller 205, to 8-bit digital data. This 8-bit digital data is stored in the second address area. The data in this area is not locked (i.e., is not write-protected).

The third address area stores and locks the fact that the cartridge has run out of toner (the event in which toner runs out is referred to as "TONER DEPLETED"), as shown in FIG. 8. This area stores only the fact that that a "0"→"1" change has taken place. After the data has been rewritten, the data is locked. When toner in the apparatus unit runs out, "replace information" indicating that replacement is necessary is stored in the third address area.

The fourth address area stores the results of performing check sums on the first to third address areas, as shown in FIG. 9. The data in this area is not locked (i.e., is not write-protected).

The seventh address area is a lock setting area 247 for setting whether the first to sixth address areas are to be locked (write-protected) or not, as shown in FIG. 10.

(Writing of Data to Third Address Area)

Figure 11:
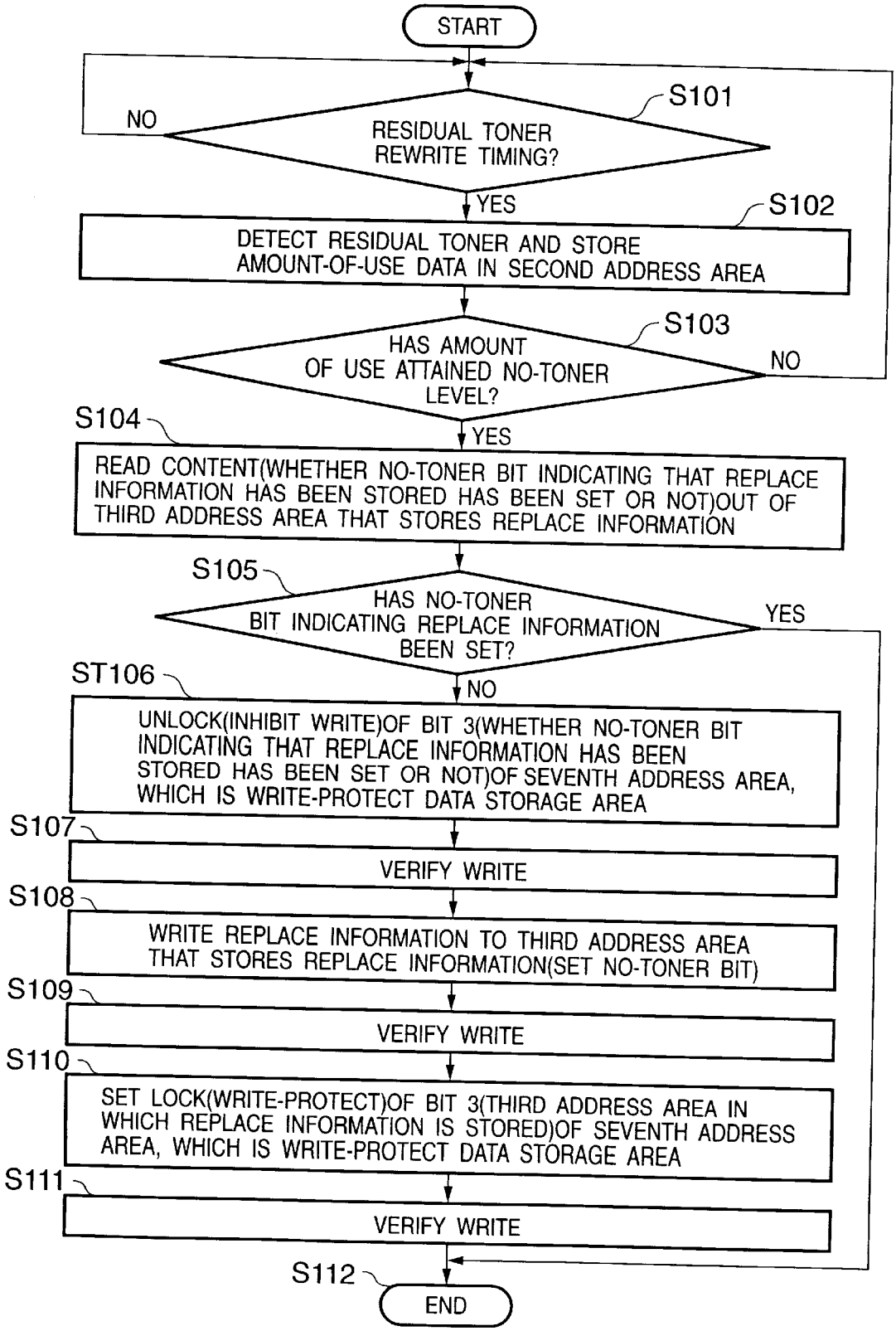
FIG. 11 is a flowchart illustrating an example in which the content of the non-volatile memory is rewritten.

A one-time write sequence for writing data to the third address area will be described with reference to the flowchart of FIG. 11.

First, at step S101, it is determined whether it is the time for rewriting the amount of toner remaining in the non-volatile memory 21. If the decision rendered is "NO", then the system waits for that time to arrive. When the rewrite time arrives ("YES" at step S101), control proceeds to step S102.

The amount of toner remaining is sensed by the piezo-electric element 218 in the developing unit 3 of toner cartridge 17 at step S102 and is reported to the residual-toner quantity controller 205 via the A/D conversion port of the CPU 225. The sensed remaining amount of toner (data indicative of amount of use) is stored in the second memory address area.

Control then proceeds to step S103, at which the measured value of remaining amount of toner (the data indicative of amount of use) is compared with a predetermined threshold value indicative of absence of toner. This state is referred to as "NO TONER".

If the value of remaining amount of toner is found to be greater than the threshold value ("NO" at step S103), measurement of amount of remaining toner continues. If the value of remaining amount of toner is found to be equal to or less than the threshold value ("YES" at step S103), then control proceeds to step S104.

The content of the third memory address area storing the replace information is read out at step S104, after which control proceeds to step S105.

In a case where information (the replace information) indicative of "NO TONER" has already been written to the third memory address area shown in FIG. 8 (i.e., if bits indicating "NO TONER" have been set) ("YES" at step S105), control proceeds to step S112 and this processing is exited.

On the other hand, if it is found at step S105 that the information (replace information) indicative of "NO TONER" has not been written to the third memory address area shown in FIG. 8 ("NO" at step S105), then control proceeds to step S106.

A first procedure for writing "TONER DEPLETED" information (the replace information) to the third address area is executed at step S106. Specifically, the third bit, which is inhibiting the writing of the third address area of the memory of the seventh address area shown in FIG. 10, is cancelled and changed to a setting that enables the writing of the third address area.

Next, this write operation is verified at step S107, after which control proceeds to step S108.

"TONER DEPLETED" information (the replace information) is written to the memory of the third address area, which is shown in FIG. 8, at step S108.

Control then proceeds to step S109, at which this write operation is verified. Control then proceeds to step S110.

Next, at step S110, the third bit, which inhibits the writing of third address area in the seventh address area shown in FIG. 10, is set to inhibit the writing of this address area, after which control proceeds to step S111.

This write operation is verified at step S111, after which control proceeds to step S112. This series of operations is then exited.

In the processing described above, processing in which the memory of the third address area is rewritten from "0" to "1" only one time is executed during use of this memory. This is followed by setting the locked state (write-protect state), in which the rewriting of "1" is inhibited.

In other words, rewriting of the memory of the third address area from "0" to "1", which indicates "TONER DEPLETED", is performed only when the initially set state "0", which indicates "TONER PRESENT", changes to the "NO TONER" state the first time. When rewrite indicative of "TONER DEPLETED" has been achieved, rewriting of "TONER DEPLETED" (the replace information) to "NO TONER" again is inhibited.

(Recovery From Write Error in Address Area)

Figure 12:
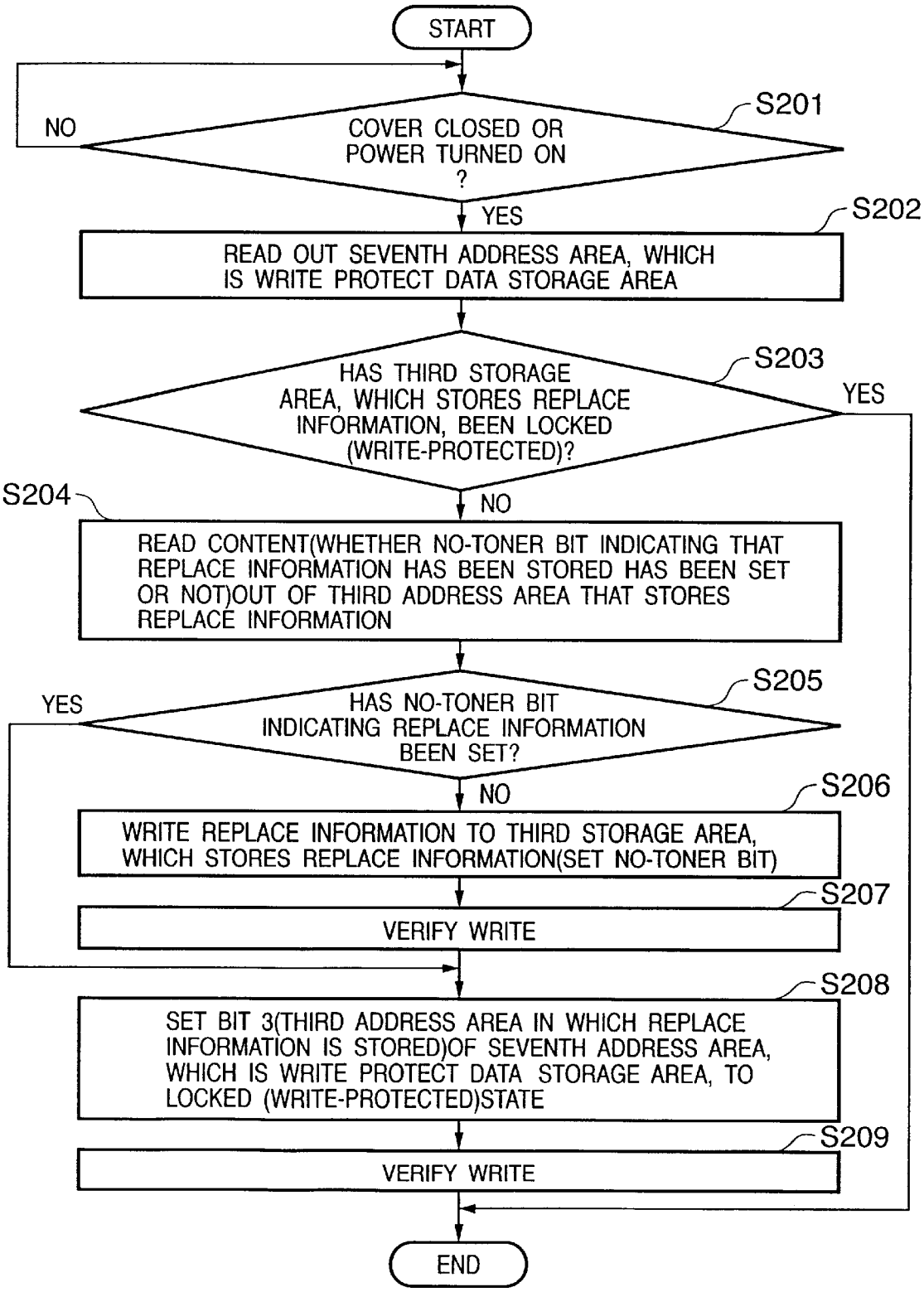
FIG. 12 is a flowchart illustrating recovery of non-volatile memory content f rom a rewrite error.

FIG. 12 is a flowchart illustrating a write-error recovery sequence in a case where an error occurs while the "TONER DEPLETED" information (the replace information) is being written to the third address area in FIG. 8.

There are various circumstances in which a write error can occur. By way of example, consider a case where the writing of a series of data cannot be completed because of a cut-off of power or the like during processing for writing the data to the third address area shown in FIG. 8 or the seventh address area shown in FIG. 10.

A method of recovery from a write error in the case mentioned above will now be described with reference to the flowchart of FIG. 12.

It is determined at step S201 whether or not power has been turned on or whether a cover for extracting a cartridge has been closed.

When introduction of power or closing of the cover has been verified ("YES" at step S201), control proceeds to step S202. Here, in order to determine whether the third address area shown in FIG. 8 is in the write-protected (locked) state, bit 3 (replace-information write-protect data) of the seventh address, which stores the write-protect data shown in FIG. 10, is read out and it is determined whether bit 3 is locked (write-protected). Control then proceeds to step S203.

If bit 3 (replace-information write-protect data) of the seventh address, which stores the write-protect data, is in the locked (write-protected) state ("YES" at step S202), processing is exited. If bit 3 of the seventh address area is in the unlocked state ("NO" at step S202), control proceeds to step S204, where the content of bit 3 of the seventh address is read out. Control then proceeds to step S205.

The content of bit 3 of the seventh address only changes from "0" to "1" at the time of rewrite. Accordingly, if bit 3 of the seventh address does not indicate "NO TONER" in a state in which bit 3 is unlocked (i.e., the content of bit 3 is "1"), then a decision can be rendered to the effect that rewrite was not completed because of cut-off of power, for example, during the rewrite operation.

Accordingly, if bit 3 of the seventh address does not indicate "NO TONER" ("NO" at step S205), then control proceeds to step S206, where the fact that bit 3 of the seventh address indicates "NO TONER" is written (i.e., where this bit is set to "TONER DEPLETED").

This is followed by step S207, at which verification is performed to check the write state, and then by step S208, at which bit 3 of the seventh address is placed in the locked state. Next, at step S209, verification is performed to check the write state, after which this series of operations is terminated.

Thus, in accordance with the present invention, as described above, the residual-toner quantity controller 205 measures the amount of remaining toner and reports the remaining amount to the determination unit 214, which determines the amount of cartridge use. In response, the determination unit 214 determines whether the toner cartridge 17 should be replaced based upon this information. If replacement is necessary, then this information is transmitted to the memory controller 213.

On the basis of the information from the determination unit 214, the memory controller 213 writes data indicating that cartridge replacement is necessary to a prescribed area of the non-volatile memory 21 in toner cartridge 17 and the memory lock function unit 215 inhibits rewriting of this area to which the data has been written.

In a case where it is judged by the memory controller 213 that rewriting of the data halted in mid-course, write-protect by the memory lock function unit 215 is cancelled and rewrite is allowed to be completed, after which rewrite is inhibited.

Thus, even if a write error with respect to a memory area occurs owing to a malfunction, restoration of the data in the memory area can be performed without providing the memory area with a back-up area. This makes it possible to conserve memory and to use memory effectively.

(Printer Control Unit According to Second Embodiment)

Figure 13:
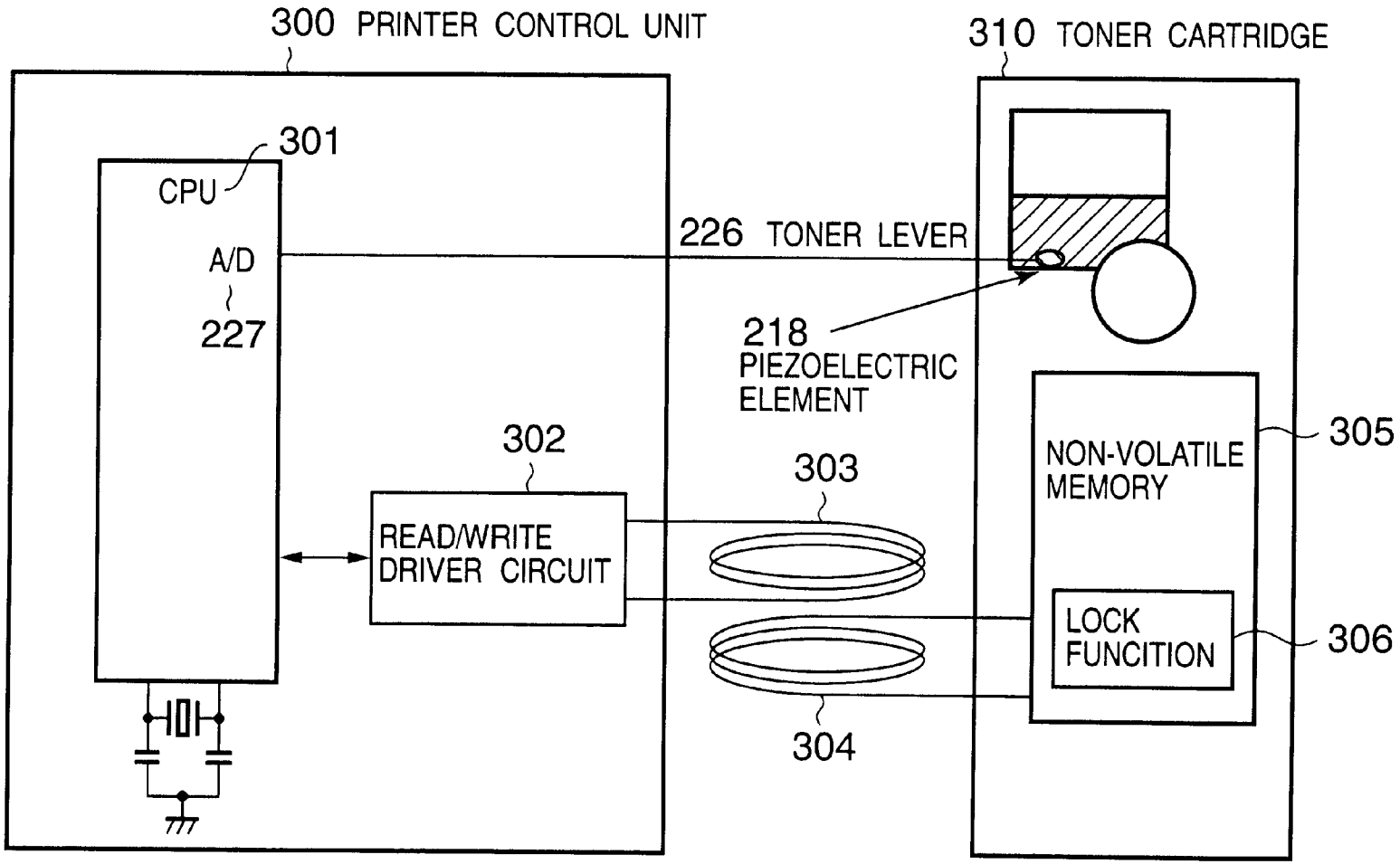
FIG. 13 is a diagram showing the connection between the printing control unit and the toner cartridge according to a second embodiment of the present invention.
Figure 14:
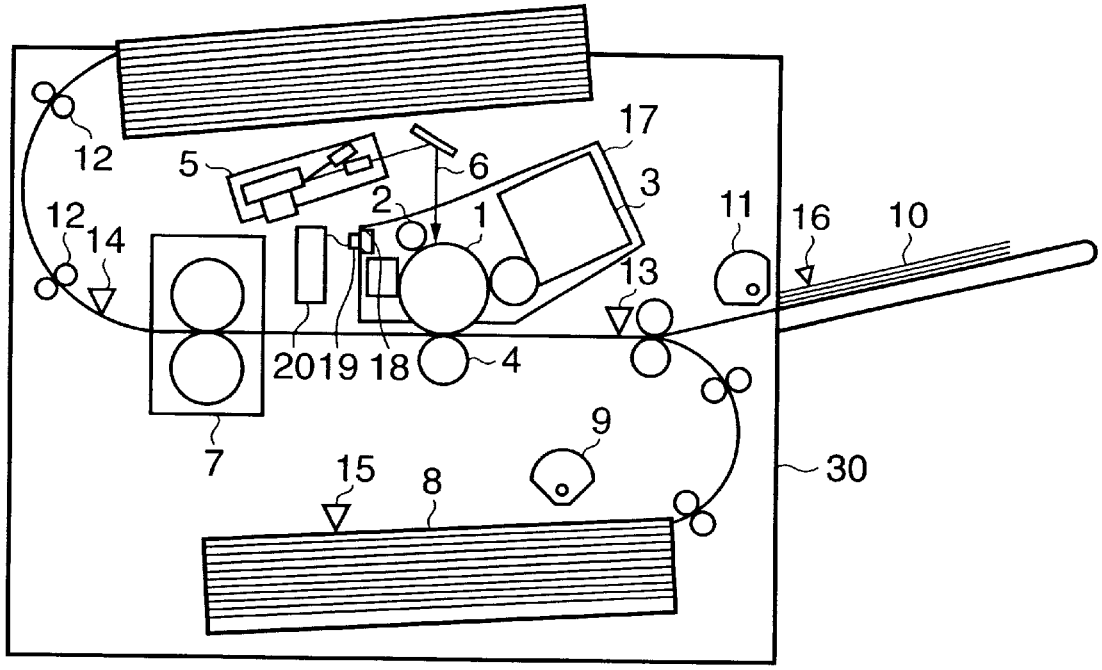
FIG. 14 is a diagram showing the overall structure of a laser printer according to the prior art.
Figure 15:
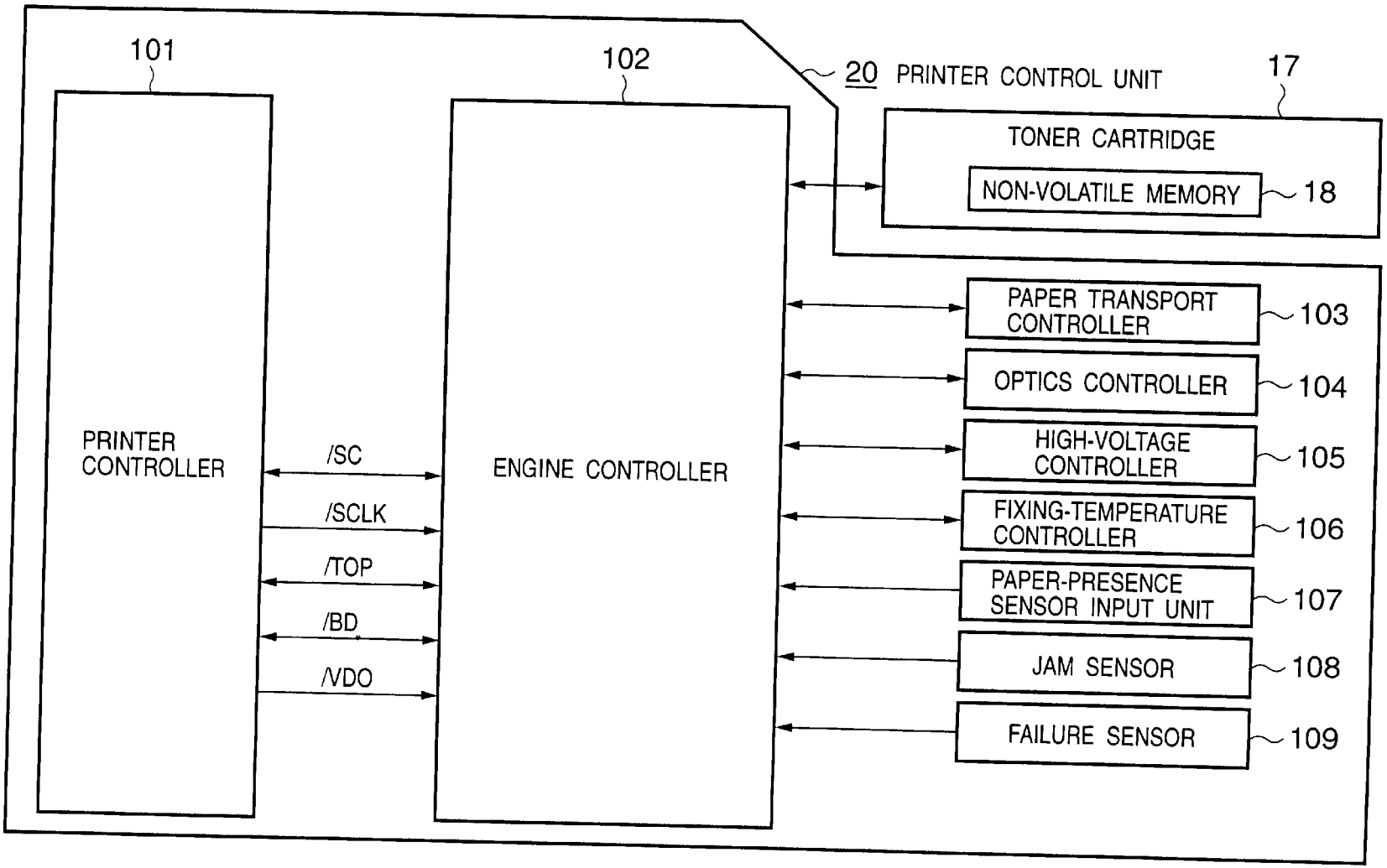
FIG. 15 is a functional block diagram of a printer control unit according to the prior art.
Figure 16:
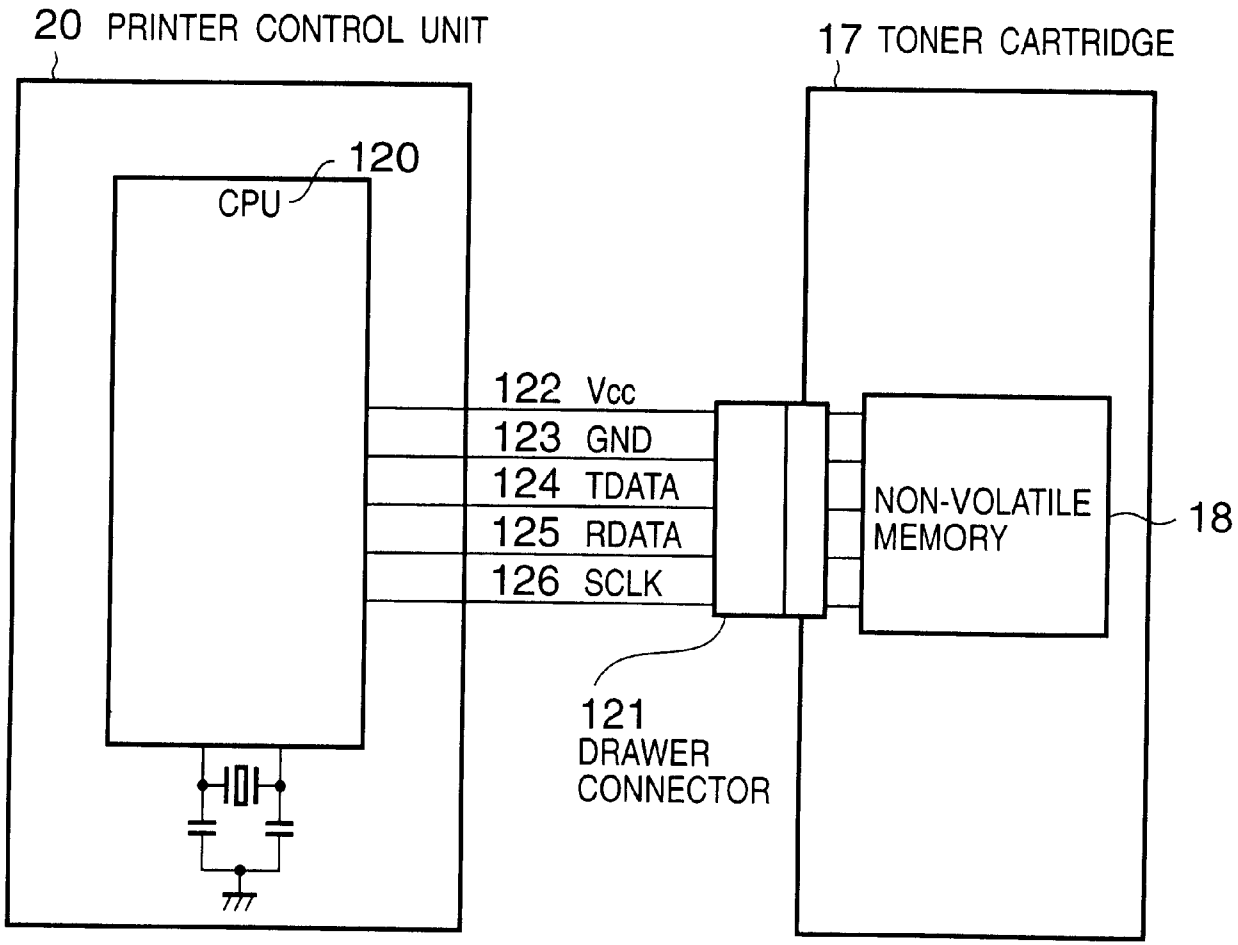
FIG. 16 is a diagram showing the connection between the printing control unit and a toner cartridge according to the prior art.
Figure 17:
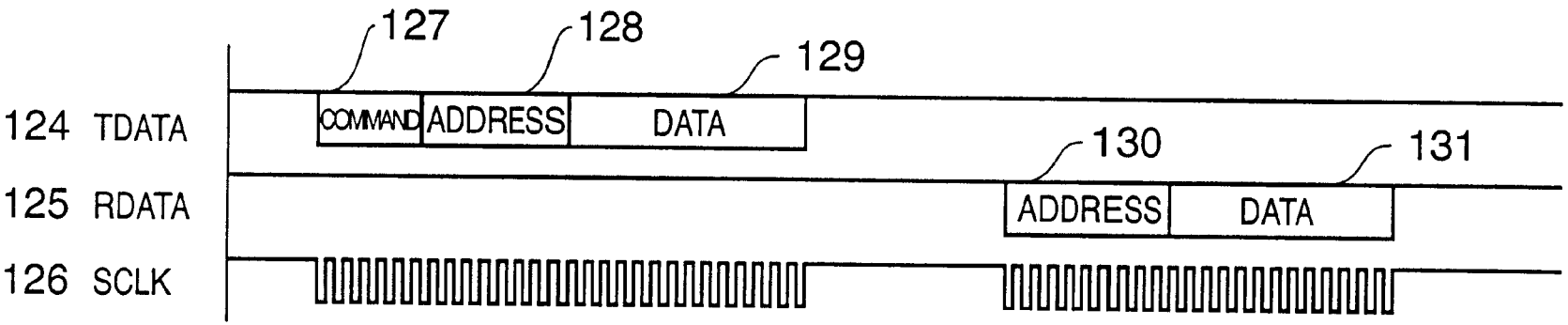
FIG. 17 is a diagram illustrating exchange of signals between the printing control unit and toner cartridge according to the prior art.
Figure 19:
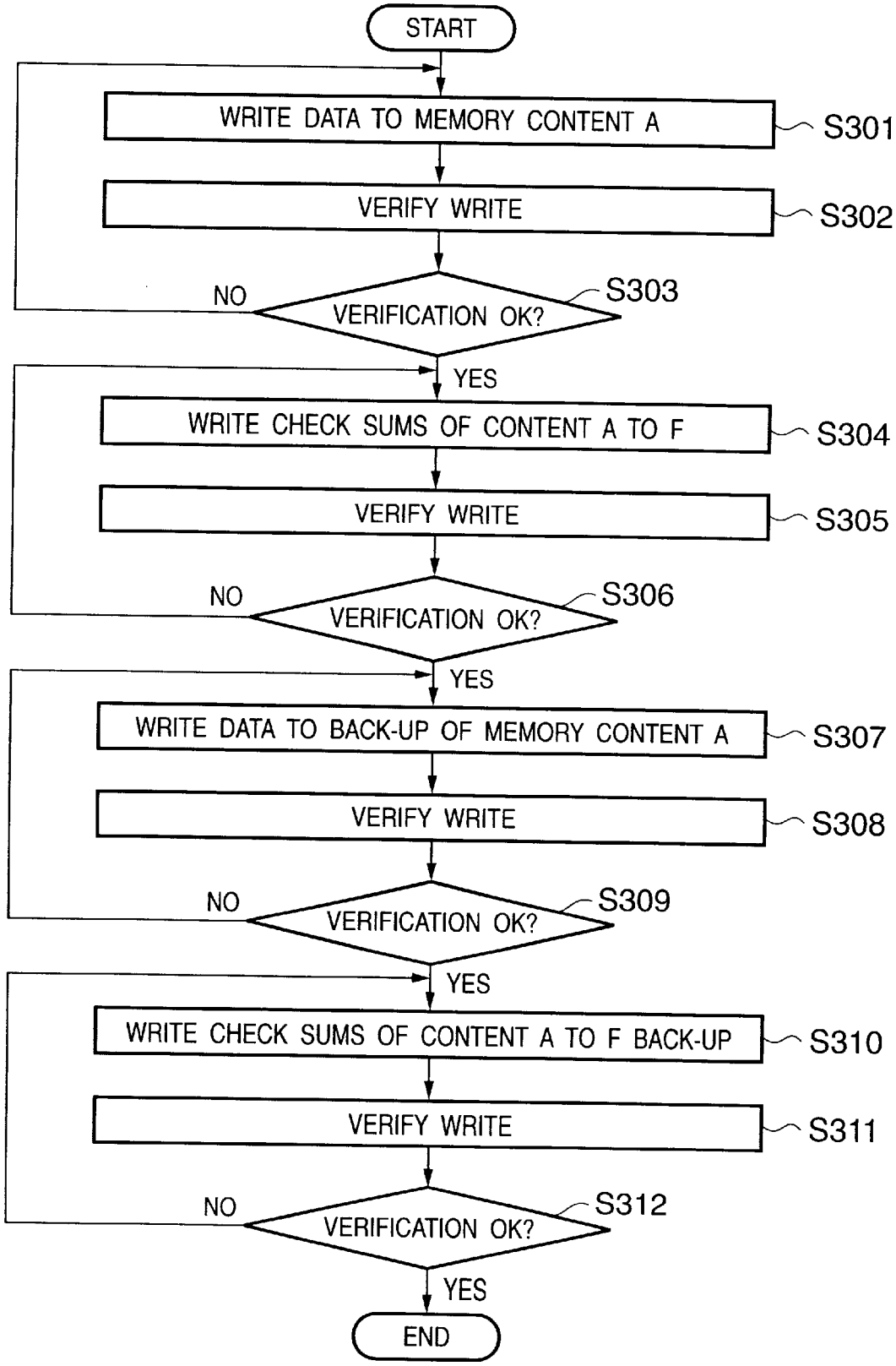
FIG. 19 is a flowchart illustrating an example in which the content of the non-volatile memory is rewritten according to the prior art.

FIG. 13 is a block diagram showing the connection and the exchange of signals between a printer control unit 300 and a toner cartridge 310 according to a second embodiment of the present invention provided in the laser printer 100 described above. The printer control unit 300 and toner cartridge 310 according to a second embodiment of the present invention will now be described in detail.

The second embodiment differs from the first embodiment only in that communication between a non-volatile memory 305 and the printer control unit 300 is contactless, as shown in FIG. 13.

Other components and operations are entirely the same as those of the first embodiment shown in FIG. 1. These components are designated by like reference characters and need not be described again.

FIG. 13 illustrates a method of rewriting data to the data area of the non-volatile memory 305 without contact between the printer control unit 300 and the toner cartridge 310. In this embodiment, the arangement is such that the interface between the non-volatile memory 305 and printer control unit 300 is not provided with electrical contacts.

Communication between the non-volatile memory 305 and printer control unit 300 is implemented by communication between a coil antenna 303 extending from the printer control unit 300 and an opposing coil antenna 304 extending from the non-volatile memory 305.

In the communication operation, a magnetic field is produced when current is passed into the coil 303 on the side of the printer control unit 300. The magnetic filed causes an electromotive force to be produced on the side of the non-volatile memory 305 due to electromagnetic induction in the coil 304 connected to the non-volatile memory 305. The electromotive force is used to activate the non-volatile memory 305.

Further, the current that flows into the coil 303 of the printer control unit 300 is amplitude-modulated at a degree of modulation of 10% with respect to the carrier frequency. Because of such modulation, data is transmitted from the printer control unit 300 to the non-volatile memory 305.

On the basis of the received data, the non-volatile memory 305 determines data that is to be sent back and digitally changes over the impedance of the connected coil 304. The change in the impedance of the coil 304 causes a change in the coefficient of electromagnetic coupling with respect to the coil 303 on the side of the printer control unit 300. The change produced at this time is received by a read/write circuit 302, which serves as a detection circuit on the side of the printer control unit 300. The printer control unit 300 therefore is capable of receiving the memory content transmitted from the non-volatile memory 305.

The read/write circuit 302 and a CPU 301 in the printer control unit 300 are connected by clock-synchronized serial communication. The read/write circuit 302 functions to convert the change in impedance, which is received from the non-volatile memory 305, to a protocol for serial communication with the CPU 301.

It should be noted that the memory content of non-volatile memory 305 is the same as that of the first embodiment, and that the lock processing associated with a lock function 306 is exactly the same as that of the lock function 217 of the first embodiment, whereby similar effects are obtained.

Further, similar effects can be achieved by similar processing even if information other than the "TONER DEPLETED" information, such as "NEW CARTRIDGE" information or "CARTRIDGE INSTALLATION DATE" information, is written to the area to be locked.

(Other Embodiments)

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the object of the invention is attained also by supplying a storage medium (or recording medium) storing the program codes of the software for performing the functions of the foregoing embodiments to a system or an apparatus, reading the program codes with a computer (e.g., a CPU or MPU) of the system or apparatus from the storage medium, and then executing the program codes. In this case, the program codes read from the storage medium implement the novel functions of the embodiments and the storage medium storing the program codes constitutes the invention. Furthermore, besides the case where the aforesaid functions according to the embodiments are implemented by executing the program codes read by a computer, it goes without saying that the present invention covers a case where an operating system or the like running on the computer performs a part of or the entire process in accordance with the designation of program codes and implements the functions according to the embodiments.

Also, the present invention further covers a case where, after the program codes read from the storage medium are written in a function expansion card inserted into the computer or in a memory provided in a function expansion unit connected to the computer, a CPU or the like contained in the function expansion card or function expansion unit performs a part of or the entire process in accordance with the designation of program codes and implements the function of the above embodiments.

In a case where the present invention is applied to the above-mentioned storage medium, program codes corresponding to the flowcharts (shown in FIGS. 11 and 12) described earlier would be stored on the storage medium.

Thus, in accordance with the present invention as described above, it is possible to provide an image forming apparatus and apparatus unit wherein by controlling the method in which data is written from the image forming apparatus to a non-volatile memory installed in the apparatus unit removably attached to the image forming apparatus, data content that has been rewritten in the non-volatile memory owing to the occurrence of a malfunction in the image forming apparatus can be restored without providing a data back-up area in the non-volatile memory.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus having an image forming apparatus main body and an apparatus unit, which has memory means, removably attached to said main body, wherein said memory means has:

a first storage area for storing data representing amount of use of said apparatus unit;

a second storage area for storing replace information indicating that replacement of said apparatus unit is necessary; and a third storage area for storing write-protect data for inhibiting a change in said second storage area, said apparatus unit being removably attached to said image forming apparatus main body;

said image forming apparatus comprising:

amount-of-use detecting means for detecting an amount of use of said apparatus unit and writing the amount of use to said memory means;

determination means for determining, on a basis of the amount of use, whether replacement of said apparatus unit is necessary and writing the replace information to said memory means if it is determined that replacement is necessary; and recovery means for determining whether processing by said determination means for writing the replace information ended normally, and causing the processing for writing the replacement information to end normally if it is determined that the processing did not end normally.

2. The apparatus according to claim 1, wherein said determination means writes write-start information, which indicates writing of the replace information has started, to said memory means, then writes the replace information and subsequently rewrites the write-start information to write-protect information.

3. The apparatus according to claim 1, wherein said recovery means makes the determination depending upon whether or not said memory means has the write-start information, the replace information and the write-protect information.

4. The apparatus according to claim 3, wherein if the write-start information is present and the replace information is absent, said recovery means writes the replace information to said memory means and then rewrites the write-start information to the write-protect information.

5. The apparatus according to claim 3, wherein if the write-start information is present and the replace information is present, said recovery means rewrites the replace information to the write-protect information.

6. The apparatus according to claim 1, wherein the determination by said recovery means is made in processing for initializing said image forming apparatus.

7. The apparatus according to claim 1, wherein said determination means determines that replacement of said apparatus unit is necessary if the amount of use detected by said amount-of-use detection means is less than a preset threshold value.

8. The apparatus according to claim 1, further comprising notification means for giving notification of the fact that the replace information has been written.

9. The apparatus according to claim 1, wherein the replace information includes at least one of (i) a date on which it was determined that replacement of said apparatus unit is necessary, and (ii) an amount of toner remaining.

10. The apparatus according to claim 1, wherein said apparatus unit is a toner cartridge.

11. The apparatus according to claim 1, wherein the amount of use is an amount of toner used.

12. An apparatus unit, which has memory means, removably attached to an image forming apparatus main body, said memory means having:

a first storage area for storing data representing amount of use of said apparatus unit;

a second storage area for storing replace information indicating that replacement of said apparatus unit is necessary; and a third storage area for storing write-protect data for inhibiting a change in said second storage area.

13. The unit according to claim 12, wherein the write-protect data is written to said third storage area after the replace information is written to said first storage area.

14. The unit according to claim 12, wherein the replace information includes at least one of (i) a date on which it was determined that replacement of said apparatus unit is necessary, and (ii) an amount of toner remaining.

15. The unit according to claim 12, wherein said apparatus unit is a toner cartridge.

16. The unit according to claim 12, wherein the data representing the amount of use is data representing an amount of toner remaining.

17. A method of controlling an image forming apparatus including an image forming apparatus main body and an apparatus unit provided with a memory having a first storage area for storing data representing an amount of use of the apparatus unit, a second storage area for storing replace information indicating that replacement of the apparatus unit is necessary, and a third storage area for storing write-protect data for inhibiting a change in the second storage area, the apparatus unit being removably attached to the image forming apparatus main body, said method comprising:

an amount-of-use detecting step of detecting the amount of use of the apparatus unit and writing the amount of use to the memory;

a determination step of determining, on a basis of the amount of use, whether replacement of the apparatus unit is necessary and writing the replace information to the memory if it is determined that replacement is necessary; and a recovery step of determining whether processing for writing the replace information at said determination step ended normally and causing the processing for writing the replacement information to end normally if it is determined that the processing did not end normally.

18. A printer comprising:

means for attaching a toner cartridge having a memory, which has first and second areas;

means for writing data into said memory; and means for reading out data stored in said memory, wherein, in a case that said means for writing writes predetermined data into said first area, said means for writing rewrites first data stored in said second area into second data prior to writing the predetermined data into said first area, and, after writing the predetermined data into said first area, said means for writing rewrites the second data in said second area into the first data.

19. The printer according to claim 18, further comprising means for discriminating whether the second data is stored in said second area, when said printer is turned on or a cover for the toner cartridge is closed.

20. The printer according to claim 18, wherein said printer accesses said memory without electrical contact.

21. A control method for a printer capable of attaching a toner cartridge having a memory, said method comprising the steps of:

determining whether predetermined data relating to the toner cartridge is to be written into a first area of the memory;

in a case that the predetermined data is determined to be written into the first area, rewriting first data stored in a second area of the memory into second data;

writing the predetermined data into the first area after rewriting the first data into the second data; and rewriting the second data in the second area into the first data after writing the predetermined data into the first area.

22. The method according to claim 21, further comprising a step of detecting a remaining amount of toner in the toner cartridge, wherein, in said determining step, it is determined whether the predetermined data is to be written into the first area in accordance with the detected remaining amount of toner in the toner cartridge.

23. The method according to claim 21, further comprising the steps of:

discriminating whether the second data is stored in the second area, when the printer is turned on and/or when a cover for the toner cartridge is closed; and rewriting the second data in the second area into the first data, when it is discriminated that the second data is stored in the second area.

24. The method according to claim 23, further comprising the steps of:

discriminating whether data stored in the first area is to be rewritten into the predetermined data, when it is discriminated that the second data is stored in the second area; and rewriting the data in the first area into the predetermined data prior to rewriting the second data in the second area into the first data, when it is discriminated that the data stored in the first area is to be rewritten into the predetermined data.

25. The method according to claim 21, wherein access to the memory is executed using a wireless communication.

26. A printer capable of attaching a toner cartridge having a memory comprising:

determining means for determining whether predetermined data relating to said toner cartridge is to be written into a first area of said memory;

first rewriting means for, in a case that the predetermined data is determined to be written into the first area, rewriting first data stored in a second area of said memory into second data;

writing means for writing the predetermined data into the first area after rewriting the first data in the second area into the second data; and second rewriting means for rewriting the second data in the second area into the first data after writing the predetermined data into said first area.

27. The printer according to claim 26, further comprising means for detecting a remaining amount of toner in said toner cartridge, wherein said determining means determines whether the predetermined data is to be written into the first area in accordance with the detected remaining amount of toner in said toner cartridge.

28. The printer according to claim 26, further comprising:

first discriminating means for discriminating whether the second data is stored in the second area, when said printer is turned on and/or when a cover for the toner cartridge is closed; and third rewriting means for rewriting the second data in the second area into the first data, when said first discriminating means discriminates that the second data is stored in the second area.

29. The printer according to claim 28, further comprising:

second discriminating means for discriminating whether data stored in the first area is to be rewritten into the predetermined data, when said first discriminating means discriminates that the second data is stored in the second area; and fourth rewriting means for rewriting the data in the first area into the predetermined data prior to rewriting the second data in the second area into the first data, when said second discriminating means discriminates that the data in the first area is to be rewritten into the predetermined data.

30. The printer according to claim 26, wherein access to said memory is executed using a wireless communication.

31. A toner cartridge capable of being attached to a printer comprising:

a memory; and receiving/transmitting means for receiving data from the printer and for transmitting data to the printer;

wherein said memory has a first area, into which predetermined data relating to said toner cartridge is to be written, and a second area, data of which is to be rewritten from first data into second data prior to writing the predetermined data into said first area, when the predetermined data is determined to be written into said first area of said memory, and data of which is to be rewritten from the second data into the first data after writing the cartridge data into said first area.

32. The toner cartridge according to claim 31, wherein the predetermined data relates to the remaining amount of toner in said toner cartridge.

33. The toner cartridge according to claim 31, wherein said second area is an area, data of which is to be rewritten from the second data into the first data in a case that the second data is stored in said second area when said printer is turned on and/or when a cover for the toner cartridge is closed, and wherein said first area is an area, data of which is to be rewritten into the predetermined data, in a case that the predetermined data is not stored in said first area when the second data in said second area is rewritten into the first data.

34. The toner cartridge according to claim 31, wherein said receiving/transmitting means has no electrical contact with said printer.

35. The method according to claim 22, wherein, in said determining step, it is determined that the predetermined data is to be written into the first area in a case that the detected remaining amount of toner cartridge is lower than a predetermined amount.

36. The method according to claim 21, wherein writing data into the first area of the memory is inhibited in a case that the first data stored in the second area of the memory, while allowed in a case that the second data stored in the second area of the memory.

37. The method according to claim 21, wherein the toner cartridge includes a photosensitive drum.

38. The printer according to claim 27, wherein said determining means determines that the predetermined data is to be written into the first area in a case that the detected remaining amount of toner in said toner cartridge is lower than a predetermined amount.

39. The printer according to claim 26, wherein said writing means is inhibited to write data into the first area in a case that the first data stored in the second area of the memory, while allowed to write data into the first area in a case that the second data stored in the second area of the memory.

40. The printer according to claim 26, wherein the toner cartridge includes a photosensitive drum.

41. The toner cartridge according to claim 32, wherein the predetermined data is determined to be written into said first area of said memory in a case that the remaining amount of toner in said toner cartridge is lower than a predetermined amount.

42. The toner cartridge according to claim 31, wherein the writing data into said first area of said memory is inhibited in a case that the first data stored in said second area of said memory, while allowed in a case that the second data stored in said second area of the memory.

43. The toner cartridge according to claim 31, wherein the toner cartridge includes a photosensitive drum.

44. A memory unit for a toner cartridge capable of being attached to a printer comprising:

a memory; and receiving/transmitting means for receiving data from the printer and for transmitting data to the printer;

wherein said memory has a first area, into which predetermined data relating to said toner cartridge is to be written, and a second area, data of which is to rewritten from first data into second data prior to writing the predetermined data into said first area, when the predetermined data is determined to be written into said first area of said memory, and data of which is to be rewritten from the second data into the first data after writing the predetermined data into said first area.

45. The memory unit according to claim 44, wherein the predetermined data relates to the remaining amount of toner in said toner cartridge.

46. The memory unit according to claim 44, wherein the predetermined data is determined to be written into said first area of said memory in a case that the remaining amount of toner in said toner cartridge is lower than a predetermined amount.

47. The memory unit according to claim 45, wherein said second area is an area, data of which is to be rewritten from the second data into the first data, in a case that the second data is stored in said second area when said printer is turned on and/or when a cover for the toner cartridge is closed, and wherein said first area is an area, data of which is to be rewritten into the predetermined data, in a case that the predetermined data is not stored in said first area when the second data in said second area is rewritten into the first data.

48. The memory unit according to claim 44, wherein writing data into said first area is inhibited in a case that the first data stored in said second area of said memory, while allowed in a case that the second data stored in said second area of said memory.

49. The memory unit according to claim 44, wherein said receiving/transmitting means has no electrical contact with said printer.

50. The memory unit according to claim 44, wherein the memory unit is attached to the toner cartridge which includes a photosensitive drum.

* * * * *

UNITED STATES PATENT AND TRADEMARK OFFICE

CERTIFICATE OF CORRECTION

PATENT NO. : 6,631,248 B2
DATED : October 7, 2003
INVENTOR(S) : Yoji Serizawa

It is certified that error appears in the above-identified patent and that said Letters Patent is hereby corrected as shown below:

Drawings,
SHEET 9, FIGURE 9, “ADDRESS 1 TO 3” should read -- ADDRESSES 1 TO 3 --.

Column 4,
Line 5, “the-writing” should read -- the writing --.

Column 5,
Line 53, “f rom” should read -- from --.

Column 8,
Line 39, “231 an data 232” should read -- 231 and data 232 --.

Column 9,
Line 4, “fact that that” should read -- fact that --.

Column 11,
Line 66, “magnetic filed” should read -- magnetic field --.

Column 16,
Line 49, “printer;” should read -- printer, --.

Column 17,
Line 38, “wherein the” should read -- wherein --.

UNITED STATES PATENT AND TRADEMARK OFFICE

CERTIFICATE OF CORRECTION

PATENT NO. : 6,631,248 B2
DATED : October 7, 2003
INVENTOR(S) : Yoji Serizawa

It is certified that error appears in the above-identified patent and that said Letters Patent is hereby corrected as shown below:

Column 18,
Line 3, “printer;” should read -- printer, --; and
Line 6, “rewritten” should read -- be rewritten --.

Signed and Sealed this

Twenty-second Day of June, 2004

JON W. DUDAS
*Acting Director of the United States Patent and Trademark Office*